US009195194B2

(12) United States Patent
Kishimoto

(10) Patent No.: US 9,195,194 B2
(45) Date of Patent: Nov. 24, 2015

(54) IMAGE FORMING APPARATUS WITH COVER FOR MAINTENANCE OF INTERIOR THEREOF, AND OPENING/CLOSURE DETECTING METHOD

(71) Applicant: KYOCERA Document Solutions Inc., Osaka (JP)

(72) Inventor: Mitsuyuki Kishimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/634,773

(22) Filed: Feb. 28, 2015

(65) Prior Publication Data

US 2015/0248096 A1 Sep. 3, 2015

(30) Foreign Application Priority Data

Feb. 28, 2014 (JP) ..... 2014-038311
Feb. 28, 2014 (JP) ..... 2014-038312

(51) Int. Cl.
*G03G 15/00* (2006.01)
*G03G 21/16* (2006.01)

(52) U.S. Cl.
CPC ..... *G03G 15/55* (2013.01); *G03G 21/1633* (2013.01)

(58) Field of Classification Search
CPC ..... G03G 15/55; G03G 15/205; G03G 15/50; G03G 15/1633
USPC ..... 399/9, 76, 85, 88, 89
See application file for complete search history.

(56) References Cited

U.S. PATENT DOCUMENTS

2006/0226801 A1* 10/2006 Yoo ..... G03G 15/55 318/434
2011/0182614 A1* 7/2011 Onuma ..... G03G 21/1633 399/110
2012/0062929 A1* 3/2012 Ishii ..... G03G 21/1652 358/1.14
2013/0188979 A1* 7/2013 Okada ..... H02J 9/005 399/88

FOREIGN PATENT DOCUMENTS

JP 2004-148724 A 5/2004

* cited by examiner

*Primary Examiner* — Walter L Lindsay, Jr.
*Assistant Examiner* — Jessica L Eley
(74) *Attorney, Agent, or Firm* — Hawaii Patent Services; Nathaniel K. Fedde; Kenton N. Fedde

(57) ABSTRACT

Provided is an image forming apparatus capable of detecting the ON/OFF state of each of two interlock switches connected in series to a power line, and detecting the opening/closure of each of two covers. The first and second interlock switches are set on/off according to the opening/closure of the first and second covers respectively. The first interlock switch is connected to a supply voltage when the first interlock switch is on, and is connected to a detection voltage being lower and on which the load does not operate when the first interlock switch is off. A control part detects the opening/closure of the first cover and the second cover based on a voltage on the power line between the first interlock switch and the second interlock switch and a voltage on the power line between the second interlock switch and the load.

7 Claims, 11 Drawing Sheets

| | FIRST COVER | SECOND COVER | VOLTAGE Va | VOLTAGE Vb | FIRST COMPARISON PART | SECOND COMPARISON PART |
|---|---|---|---|---|---|---|
| NORMAL MODE | CLOSED | CLOSED | 24V | 24V | High | High |
| | | OPEN | | 0V | | Low |
| | OPEN | CLOSED | 3.3V | 3.3V | Low | High |
| | | OPEN | | 0V | | Low |
| SLEEP MODE | CLOSED | CLOSED | 0V | 0V | Low | Low |
| | | OPEN | | 0V | | Low |
| | OPEN | CLOSED | 3.3V | 3.3V | High | High |
| | | OPEN | | 0V | | Low |

| | FIRST COVER | SECOND COVER | VOLTAGE Va | VOLTAGE Vb | FIRST COMPARISON PART | SECOND COMPARISON PART |
|---|---|---|---|---|---|---|
| NORMAL MODE | CLOSED | CLOSED | 24V | 24V | High | High |
| | | OPEN | | 0V | | Low |
| | OPEN | CLOSED | 3.3V | 3.3V | Low | High |
| | | OPEN | | 0V | | Low |
| SLEEP MODE | CLOSED | CLOSED | 0V | 0V | Low | Low |
| | | OPEN | | 0V | | Low |
| | OPEN | CLOSED | 3.3V | 3.3V | High | High |
| | | OPEN | | 0V | | Low |

FIG. 6

| | LOCK STATE OF FIRST COVER | | FIRST COVER | SECOND COVER | VOLTAGE Va | VOLTAGE Vb | FIRST COMPARISON PART | | SECOND COMPARISON PART | |
|---|---|---|---|---|---|---|---|---|---|---|
| NORMAL MODE | UPON DETECTION OF JAMMING | YES | CLOSED | CLOSED | 24V | 24V | FIRST THRESHOLD | High | THIRD THRESHOLD | High |
| | | | | OPEN | | 0V | | | | Low |
| | UPON DETECTION OF NO JAMMING | NO | CLOSED | CLOSED | 24V | 24V | | High | SECOND THRESHOLD | High |
| | | | | OPEN | | 0V | | | | Low |
| | | | OPEN | CLOSED | 3.3V | 3.3V | | Low | | High |
| | | | | OPEN | | 0V | | | | Low |
| SLEEP MODE | | | CLOSED | CLOSED | 0V | 0V | SECOND THRESHOLD | Low | | Low |
| | | | | OPEN | | 0V | | | | Low |
| | | | OPEN | CLOSED | 3.3V | 3.3V | | High | | High |
| | | | | OPEN | | 0V | | | | Low |

FIG.11

IMAGE FORMING APPARATUS WITH COVER FOR MAINTENANCE OF INTERIOR THEREOF, AND OPENING/CLOSURE DETECTING METHOD

INCORPORATION BY REFERENCE

This application is based on and claims the benefit of priority from Japanese Patent Application No. 2014-038311 filed on Feb. 28, 2014 and Japanese Patent Application No. 2014-038312 filed on Feb. 28, 2014, the contents of which are hereby incorporated by reference.

BACKGROUND

The present disclosure relates to an image forming apparatus with a cover for maintenance of the interior thereof, and an opening/closure detecting method, and, more particularly, to an image forming apparatus with an interlock switch for detecting the open/closed state of a cover, and an opening/closure detecting method for the cover.

An image forming apparatus, such as a printer or a copying machine, includes a cover for maintenance of the interior thereof (supplement of toner, resolution of paper jam, or the like), and an interlock switch provided on the cover. Accordingly, the image forming apparatus is controlled in such a way that an image forming operation is not performed to secure safety when the cover is open.

In a typical case of an image forming apparatus, an interlock switch provided between an output control part and a drive part connects the output control part to the drive part with a cover closed. According to this image forming apparatus, the interlock switch provided between an output control part and a drive part connects the output control part to the drive part with a cover closed. With the cover being open, the interlock switch connects a cover opening/closure detecting circuit to the drive part. Further, this image forming apparatus can detect the open/closed state of the cover even if power supply to the drive part is stopped in sleep mode. In sleep mode, therefore, a small power supply different from the power supply that supplies power to the drive part is used for the cover opening/closure detecting circuit.

SUMMARY

An image forming apparatus according to the present disclosure includes a first cover, a second cover, a first interlock switch that is set on/off according to opening/closure of the first cover, a second interlock switch that is set on/off according to opening/closure of the second cover, and a cover opening/closure detecting part. The first interlock switch and the second interlock switch are connected in series to a power line through which a load is supplied with power from a supply voltage. The first interlock switch is connected to the supply voltage to supply the supply voltage to the power line when the first interlock switch is on, and is connected to a detection voltage which is lower than the supply voltage and on which the load does not operate to supply the detection voltage to the power line when the first interlock switch is off. The cover opening/closure detecting part detects opening/closure of each of the first cover and the second cover based on a voltage on the power line between the first interlock switch and the second interlock switch and a voltage on the power line between the second interlock switch and the load.

An image forming apparatus according to the present disclosure includes a first cover; a second cover; a first interlock switch that is set on/off according to opening/closure of the first cover, connects a power line through which a load is supplied with power to a supply voltage when the first interlock switch is on, and connects the power line to a detection voltage which is lower than the supply voltage and on which the load does not operate; a second interlock switch that sets the power line between the first interlock switch and the load on/off according to opening/closure of the second cover; a first comparison part that compares a voltage on the power line between the first interlock switch and the second interlock switch with a set threshold; a second comparison part that compares a voltage on the power line between the second interlock switch and the load with the set threshold; a threshold setting part that sets the threshold which is used in each of the first comparison part and the second comparison part; and a cover opening/closure detecting part that detects opening/closure of each of the first cover and the second cover according to results of comparison performed by the first comparison part and the second comparison part. The threshold setting part sets the threshold to be used in the first comparison part to a first threshold between the detection voltage and the supply voltage in normal mode, and sets the threshold to be used in the first comparison part to a second threshold between 0 V and the detection voltage in sleep mode. The threshold setting part sets the threshold to be used in the second comparison part to the second threshold when jamming is not detected, and sets the threshold to be used in the second comparison part to a third threshold higher than a voltage of an electromotive force when jamming is detected. The voltage of the electromotive force lies between 0 V and the supply voltage and is likely generated on the load at a time of dealing with jamming.

An opening/closure detecting method according to the present disclosure is for use in an image forming apparatus in which a first interlock switch that is set on/off according to opening/closure of a first cover, and a second interlock switch that is set on/off according to opening/closure of a second cover are connected in series to a power line through which a load is supplied with power from a supply voltage. The opening/closure detecting method includes connecting the first interlock switch to the supply voltage to supply the supply voltage to the power line when the first interlock switch is on; connecting the first interlock switch to a detection voltage which is lower than the supply voltage and on which the load does not operate to supply the detection voltage to the power line when the first interlock switch is off; and detecting opening/closure of each of the first cover and the second cover based on a voltage on the power line between the first interlock switch and the second interlock switch and a voltage on the power line between the second interlock switch and the load.

BRIEF DESCRIPTION OF THE DRAWINGS

FIG. 6 is a table showing the results of determination made by a control part illustrated in FIG. 4;

FIG. 11 is a table showing the results of determination made by a control part illustrated in FIG. 8.

DETAILED DESCRIPTION

<First Embodiment>

The following specifically describes a first embodiment of the present disclosure referring to FIGS. 1 to 6.

Figure 1:
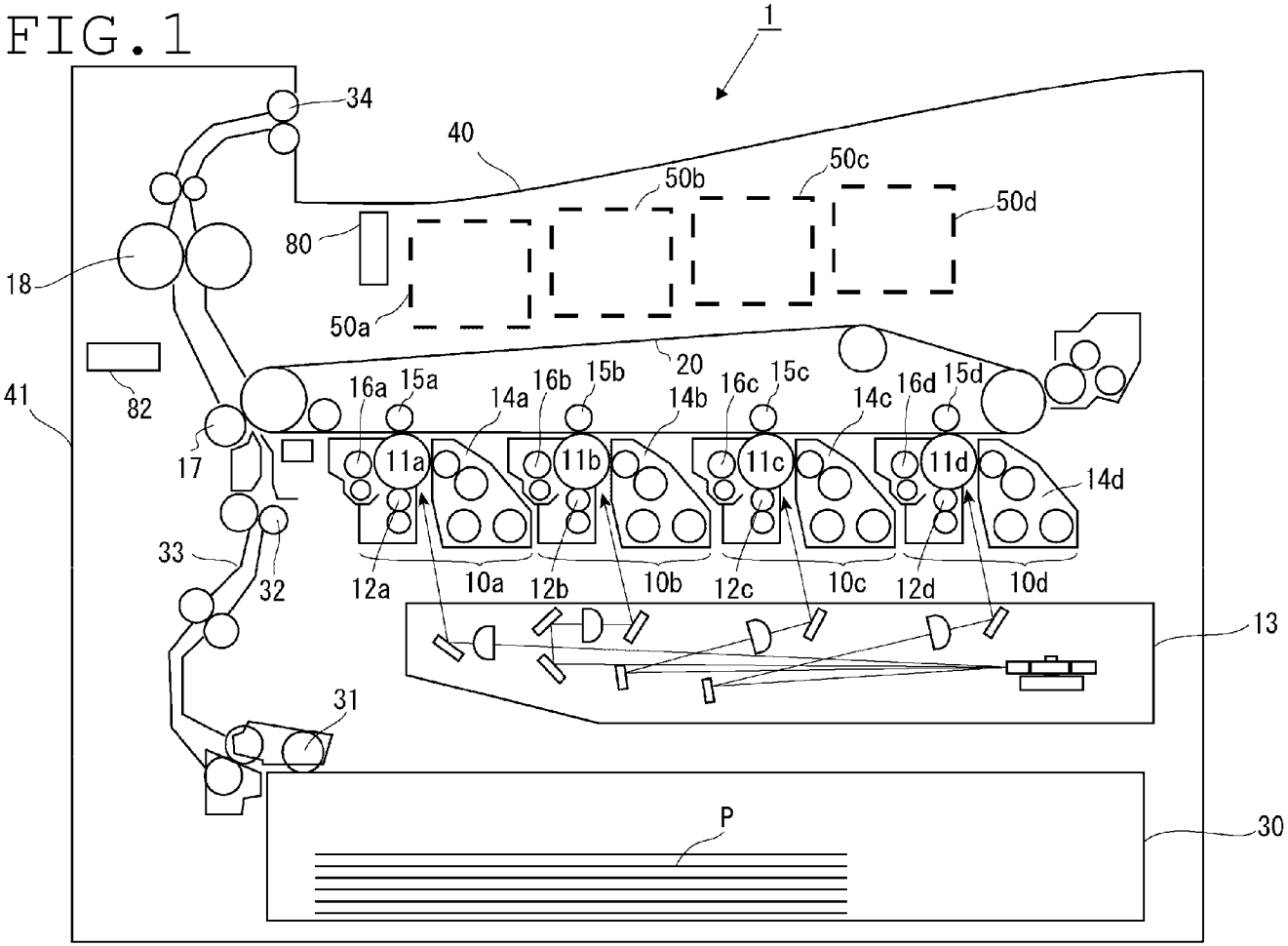
FIG. 1 is a schematic explanatory sectional view illustrating the internal configuration of an image forming apparatus according to a first embodiment of the present disclosure.

Referring to FIG. 1, an image forming apparatus according to the first embodiment is a color printer 1 in which four image forming parts 10*a*, 10*b*, 10*c*, and 10*d* respectively corresponding to color image data of different four colors of C (Cyan), M (Magenta), Y (Yellow) and K (Black) are disposed. An intermediate transfer belt 20 is provided adjacent to the upper portions of the four image forming parts 10*a*, 10*b*, 10*c*, and 10*d*.

Figure 2:
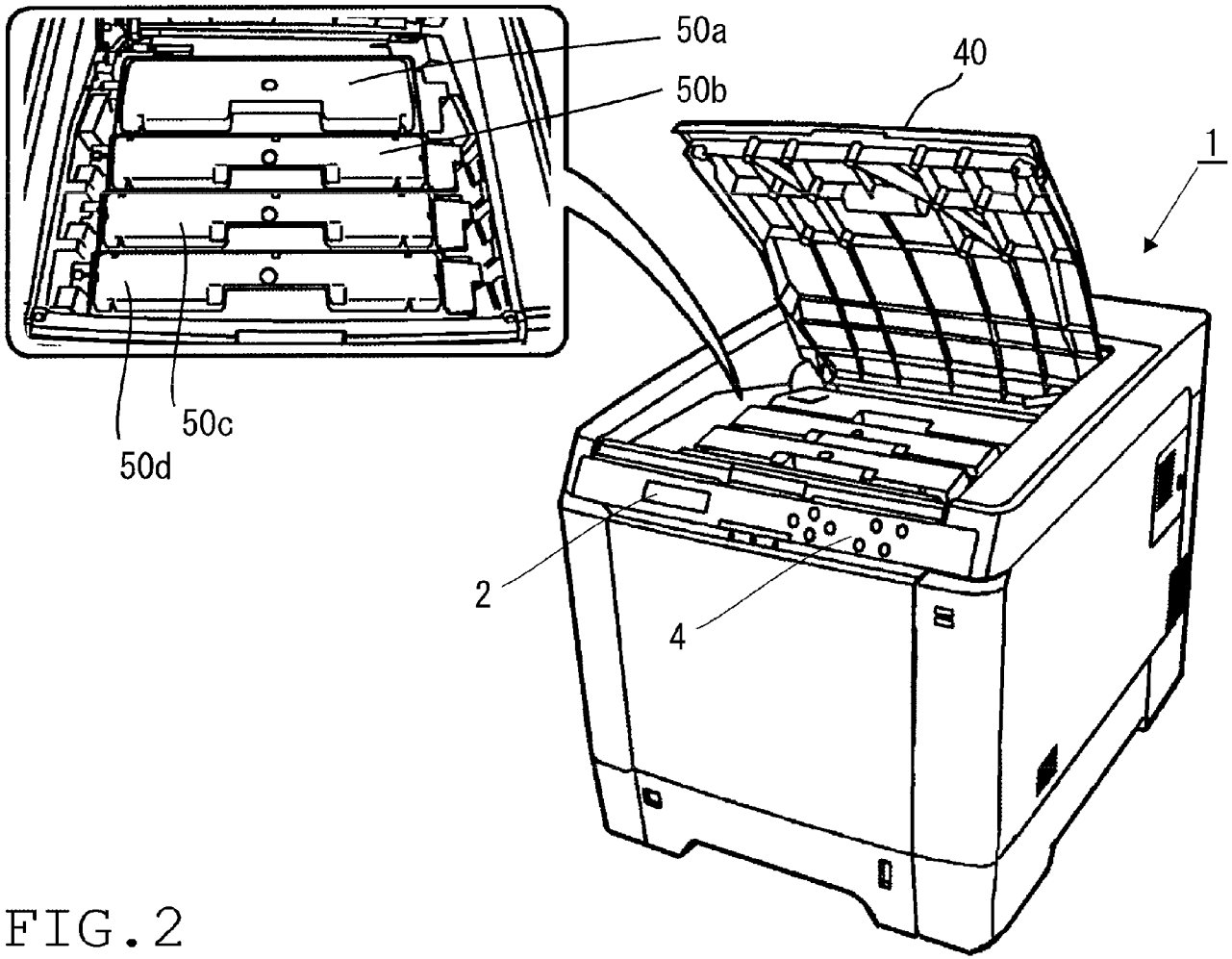
FIG. 2 is an external perspective view illustrating that a first cover of the image forming apparatus illustrated in FIG. 1 is open.

Referring to FIG. 2, the top side of the color printer 1 is provided with a first cover 40. Opening the first cover 40 opens space above the intermediate transfer belt 20, so that toner containers 50*a*, 50*b*, 50*c*, and 50*d* are mountable/dismountable. The toner containers 50*a*, 50*b*, 50*c*, and 50*d* respectively contain toners of four colors of C (Cyan), M (Magenta), Y (Yellow) and K (Black) that are to be supplied to the four image forming parts 10*a*, 10*b*, 10*c*, and 10*d*, respectively. A display part 2 such as a liquid crystal display illustrated in FIG. 2 displays the status of the color printer 1. An operation part 4 accepts various instructions issued by a user. As illustrated in FIG. 1, the first cover 40 is provided with a first interlock switch 80 that is set on/off according to the opening/closure of the first cover 40. The first interlock switch 80 is configured in such a way that when the first cover 40 is open, the first interlock switch 80 shuts off a supply voltage to be supplied to the individual components of the color printer 1.

Photo conductor drums 11*a*, 11*b*, 11*c*, and 11*d* that carry visible images (toner images) of the individual colors are respectively disposed in the four image forming parts 10*a*, 10*b*, 10*c*, and 10*d*. Provided around the photo conductor drums 11*a*, 11*b*, 11*c*, and 11*d* are charging units 12*a*, 12*b*, 12*c*, and 12*d*, developing units 14*a*, 14*b*, 14*c*, and 14*d*, an exposure unit 13, developing units 14*a*, 14*b*, 14*c*, and 14*d*, primary transfer rollers 15*a*, 15*b*, 15*c*, and 15*d*, and cleaning units 16*a*, 16*b*, 16*c*, and 16*d*. The charging units 12*a*, 12*b*, 12*c*, and 12*d* respectively charge the photo conductor drums 11*a*, 11*b*, 11*c*, and 11*d*. The exposure unit 13 exposes the photo conductor drums 11*a*, 11*b*, 11*c*, and 11*d* to form image information thereon. The developing units 14*a*, 14*b*, 14*c*, and 14*d* respectively forms toner images on the photo conductor drums 11*a*, 11*b*, 11*c*, and 11*d*. The primary transfer rollers 15*a*, 15*b*, 15*c*, and 15*d* respectively transfer the toner images on the photo conductor drums 11*a*, 11*b*, 11*c*, and 11*d* onto the intermediate transfer belt 20. The cleaning units 16*a*, 16*b*, 16*c*, and 16*d* respectively removes developers (toners) remaining on the photo conductor drums 11*a*, 11*b*, 11*c*, and 11*d*.

The toner images formed on the photo conductor drums 11*a*, 11*b*, 11*c*, and 11*d* are sequentially transferred onto the intermediate transfer belt 20 that moves in abutment with the photo conductor drums 11*a*, 11*b*, 11*c*, and 11*d*. The toner images sequentially transferred onto the intermediate transfer belt 20 are transferred at a time on a recording sheet of paper P by a secondary transfer roller 17. Recording sheets P are retained in a sheet paper cassette 30 disposed at a lower portion; each recording sheet P is conveyed on a recording paper conveying path 33 to the secondary transfer roller 17 via feed rollers 31 and resist rollers 32. The toner images transferred onto the recording sheet P are fixed thereon in the fixing unit 18. The printed recording sheet P passes through the recording paper conveying path 33 to be ejected onto the first cover 40 by ejection rollers 34.

Figure 3:
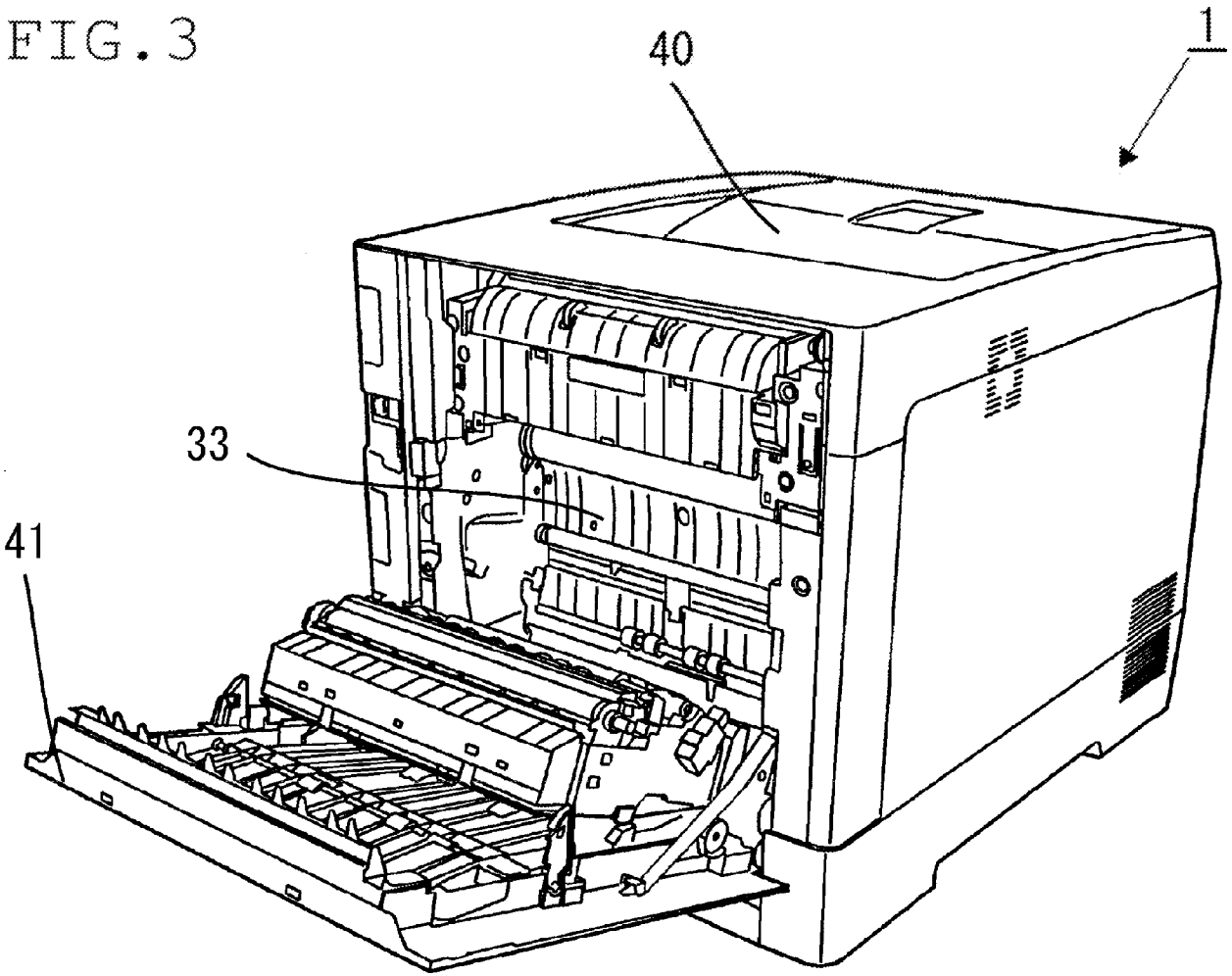
FIG. 3 is an external perspective view illustrating that a second cover of the image forming apparatus illustrated in FIG. 1 is open.

Referring to FIG. 3, the second cover 41 is provided on that side of the color printer 1 where the recording paper conveying path 33 is provided, and is configured to open the recording paper conveying path 33 as the second cover 41 is opened. This can overcome jamming of the recording sheet P in the recording paper conveying path 33. Further, as illustrated in FIG. 1, the second cover 41 is provided with an second interlock switch 82 that is set on/off according to the opening/closure of the second cover 41. The second interlock switch 82 is configured to be set off with the second cover 41 open, thereby shutting off supply of the supply voltage to the individual components of the color printer 1.

Figure 4:
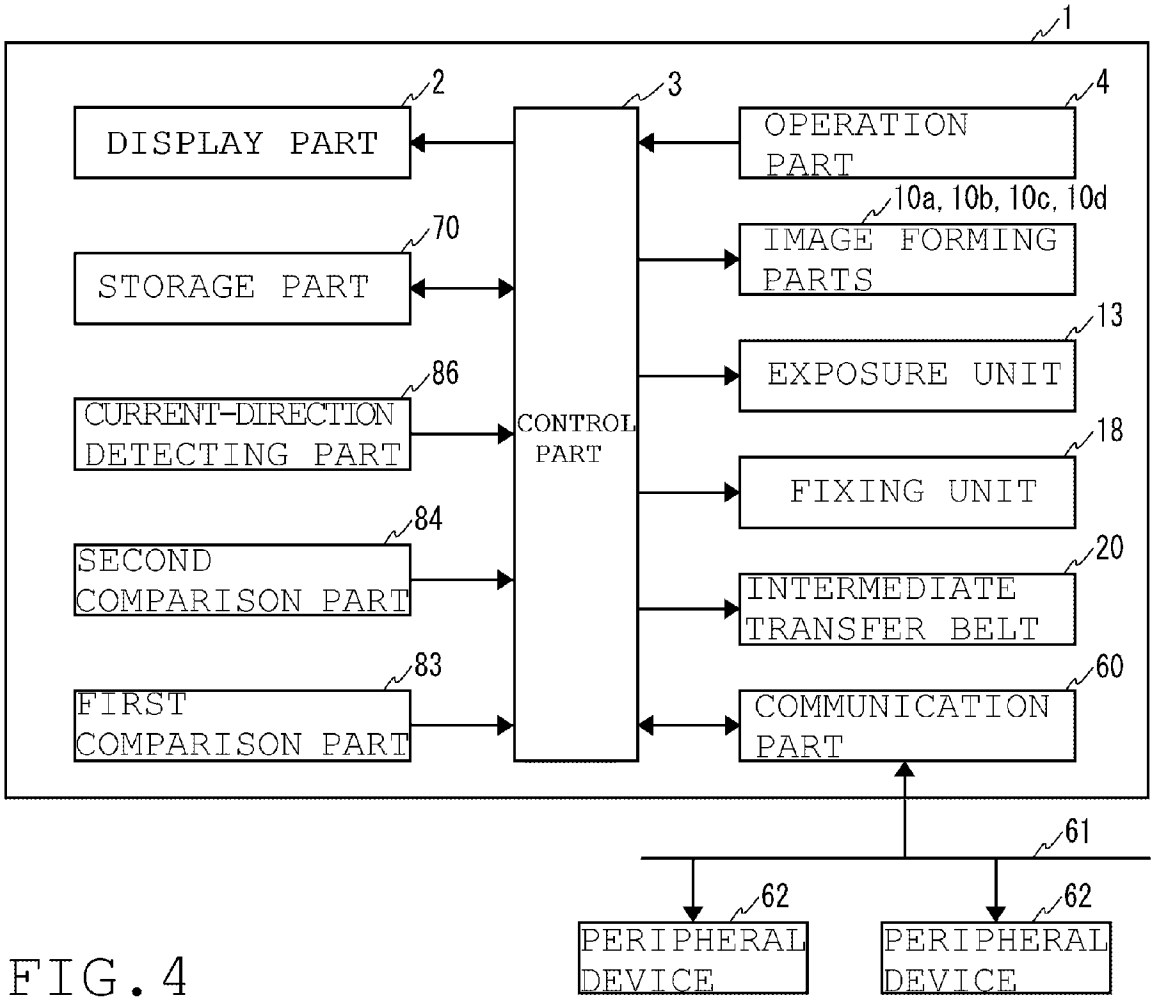
FIG. 4 is a block diagram illustrating the schematic configuration of the image forming apparatus illustrated in FIG. 1.

FIG. 4 is a block diagram illustrating the schematic configuration of the color printer 1. The color printer 1 includes a control part 3 that is connected to a communication part 60 and a storage part 70. The control part 3 is an information processing part such as a microcomputer including a non-transitory recording medium. A control program for controlling the operation of the image forming apparatus is stored in a ROM. The control part 3 reads out the control program stored in the ROM, and is then loaded into a RAM to control the individual components (such as the image forming parts 10*a*, 10*b*, 10*c*, and 10*d*, exposure unit 13, fixing unit 18 and intermediate transfer belt 20) according to specified instruction information input through the operation part 4 or a print job received over the communication part 60, thereby achieving a sequence of image forming operations. When a specified time elapses without a user's inputting an instruction or instructing to start the image forming operation through the operation part 4, the control part 3 shifts the operation mode from a normal mode to a sleep mode as power control to reduce power consumption. In sleep mode, the control part 3 controls a power supply circuit (not shown) to disable a supply voltage to be supplied to the individual components that achieve the image forming operation, and supplies a voltage sufficiently lower than the supply voltage to some standby components of the control part 3 such as a CPU.

The communication part 60 has a capability of transmitting and receiving various kinds of data to and from peripheral devices 62 such as a personal computer. The communication part 60 receives from each peripheral device 62 a print job including print data, such as color image data, to be used in image formation.

The storage part 70 includes a non-transitory recording medium, and stores print data such as color image data received by the communication part 60.

The control part 3 is connected with a first comparison part 83 and a second comparison part 84 that compare voltages on a power line with specified thresholds, and a current-direction detecting part 86 that detects a current direction on the power line. The control part 3 serves as a cover opening/closure detecting part that detects the opening/closure of the first cover 40 and the second cover 41 according to the outputs of the first comparison part 83, the second comparison part 84 and the current-direction detecting part 86, and displays the results of the detection on the display part 2 as needed to notify a user of the detection results.

Figure 5:
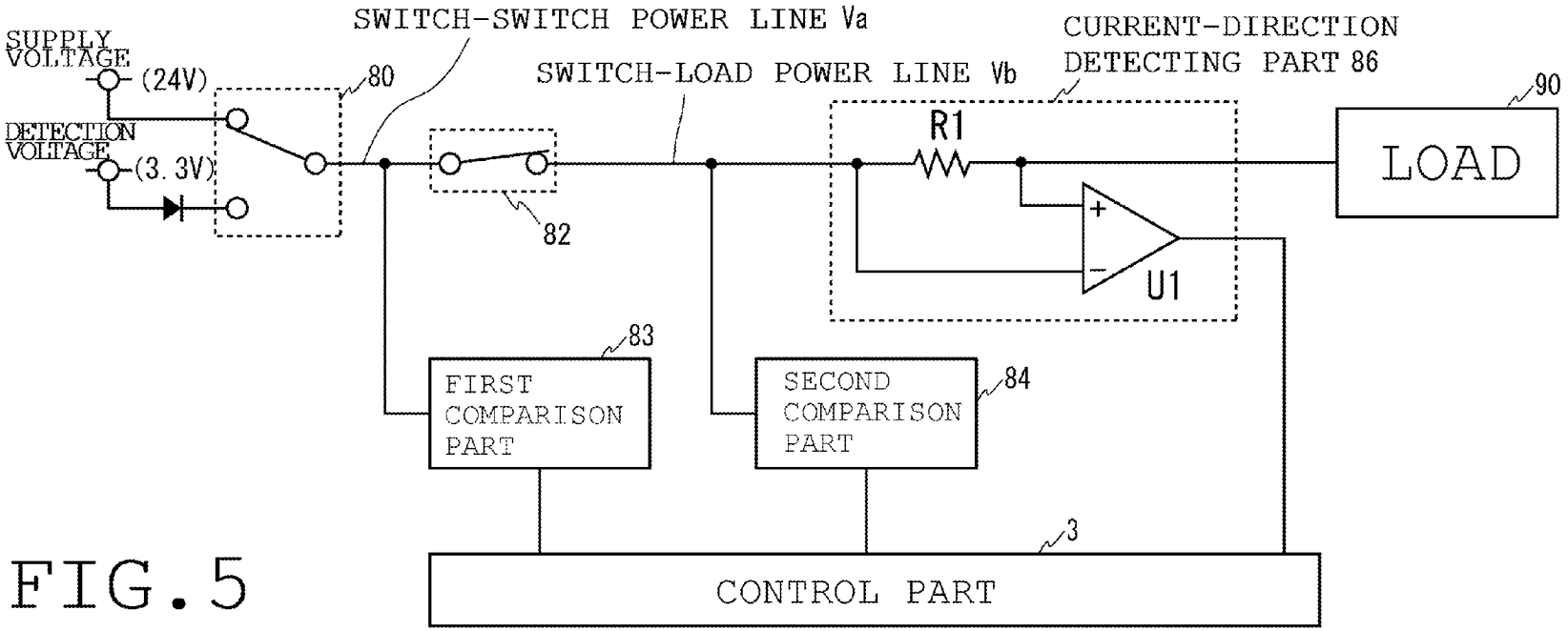
FIG. 5 is a block diagram illustrating the configuration of a cover opening/closure detecting part in the image forming apparatus illustrated in FIG. 1.

Referring to FIG. 5, the first interlock switch 80 and the second interlock switch 82 are connected in series to the power line that supplies power to a load (motor, heater or the like) 90 of each part from the supply voltage. Accordingly, when both of the first cover 40 and the second cover 41 are open or either one of the covers 40, 41 is open, at least one of the first interlock switch 80 and the second interlock switch 82 is set off to shut off the supply of the supply voltage to the load 90 of each part. When both of the first cover 40 and the second cover 41 are closed, both of the first interlock switch 80 and the second interlock switch 82 are set on to supply the supply voltage to the load 90 of each part.

The first interlock switch 80 is a one-circuit-two-contact switch disposed upstream of the second interlock switch 82. The first interlock switch 80 is connected with the supply voltage at a node that is connected when the first cover 40 is ON or closed, and is connected with a detection voltage via a back-flow preventing diode at a node that is connected when the first cover 40 is OFF or open. Accordingly, when the first cover 40 is closed, the supply voltage is supplied to the power line, and when the first cover 40 is open, the detection voltage is supplied to the power line. The detection voltage is the voltage that is sufficient lower than the supply voltage so that the load 90 does not operate on that voltage; for example, a voltage which is supplied to the CPU of the control part 3 in sleep mode is used as the detection voltage. It is assumed according to the first embodiment that the supply voltage supplied is 24 V, and the detection voltage supplied is 3.3 V.

The first comparison part 83 compares a voltage Va on the power line between the first interlock switch 80 and the second interlock switch 82 (hereinafter called "switch-switch power line") with a specified threshold, and outputs the result of the comparison to the control part 3.

In normal mode, the first comparison part 83 compares the voltage Va with a first threshold that is set to a voltage lying between the detection voltage and the supply voltage. When the voltage Va is higher than the first threshold, the first comparison part 83 outputs a high-level signal to the control part 3. When the voltage Va is lower than the first threshold, the first comparison part 83 outputs a low-level signal to the control part 3. Referring to FIG. 6, in normal mode, the voltage Va on the switch-switch power line becomes 24 V which is the supply voltage when the first cover 40 is closed, and becomes 3.3 V which is the detection voltage when the first cover 40 is open. In normal mode, therefore, the control part 3 detects that the first cover 40 is closed when a high-level signal is input from the first comparison part 83, and detects that the first cover 40 is open when a low-level signal is input from the first comparison part 83.

In sleep mode, the first comparison part 83 compares the voltage Va with a second threshold that is set to a voltage lying between 0 V and the detection voltage. When the voltage Va is higher than the second threshold, the first comparison part 83 outputs a high-level signal to the control part 3. When the voltage Va is lower than the second threshold, the first comparison part 83 outputs a low-level signal to the control part 3. Referring to FIG. 6, in sleep mode, the voltage Va on the switch-switch power line becomes 0 V (which is the supply voltage in sleep mode) when the first cover 40 is closed, and becomes 3.3 V which is the detection voltage when the first cover 40 is open. In sleep mode, therefore, the control part 3 detects that the first cover 40 is closed when a low-level signal is input from the first comparison part 83, and detects that the first cover 40 is open when a high-level signal is input from the first comparison part 83.

The second comparison part 84 compares a voltage Vb on the power line between the second interlock switch 82 and the load 90 (hereinafter called "switch-load power line") with a specified threshold, and outputs the result of the comparison to the control part 3.

The second comparison part 84 compares the voltage Vb with a second threshold that is set to a voltage lying between 0 V and the detection voltage. When the voltage Vb is higher than the second threshold, the second comparison part 84 outputs a high-level signal to the control part 3. When the voltage Vb is lower than the second threshold, the first comparison part 83 outputs a low-level signal to the control part 3. Referring to FIG. 6, in normal mode, the voltage Vb on the switch-load power line becomes 0 V, regardless of the open/closed state of the first cover 40, when the first cover 40 is open, and becomes 24 V, which is the supply voltage, or 3.3 V, which is the detection voltage, according to the opening/closure of the first cover 40, when the second cover 41 is closed. In normal mode, therefore, the control part 3 detects that the second cover 41 is closed when a high-level signal is input from the second comparison part 84, and detects that the second cover 41 is open when a low-level signal is input from the second comparison part 84.

In sleep mode, as shown in FIG. 6, the voltage Vb on the switch-load power line becomes 0 V, regardless of the opening/closure of the second cover 41, when the first cover 40 is closed, becomes 3.3 V, which is the detection voltage, when the first cover 40 is open and the second cover 41 is closed, and becomes 0 V when the first cover 40 is open and the second cover 41 is open. In sleep mode, therefore, the control part 3 detects that the second cover 41 is closed when a high-level signal is input from the second comparison part 84 only in the case where a high-level signal is input from the first comparison part 83 and the first cover 40 is open, and detects that the second cover 41 is open when a low-level signal is input from the second comparison part 84.

According to the first embodiment, the second threshold that is used in the second comparison part 84 and in sleep mode in the first comparison part 83 is a voltage lying between 0 V and the detection voltage. Since the detection voltage is such a voltage on which the load 90 does not operate as mentioned above, the voltage Va and the voltage Vb may exceed the second threshold due to electromotive force that is generated in the load 90. When the load 90 is a motor, for example, the motor rotates through a process of dealing with jamming of the recording sheet P.

According to the first embodiment, therefore, the current-direction detecting part 86 connected to the switch-load power line detects the current direction on the power line to detect electromotive force from the load 90, thereby preventing erroneous detection. For example, the current-direction detecting part 86 includes a resistor R1 connected in series to the power line, and a comparator U1 that compares voltages at both ends of the resistor R1 and outputs the result of the comparison to the control part 3.

When the current-direction detecting part 86 detects electromotive force from the load 90 in sleep mode, the control part 3 disregards a high-level signal if input from the first comparison part 83, and does not detect that the first cover 40 is opened. When the current-direction detecting part 86 detects electromotive force from the load 90 in sleep mode, the control part 3 disregards a high-level signal if input from the second comparison part 84, and does not detect that the second cover 41 is closed.

Although the first cover 40 whose top portion is openable/closable is provided with the first interlock switch 80 according to the first embodiment, the cover on which the first interlock switch 80 is provided is not limited; the first interlock switch 80 should be provided on the cover whose opening/closure needs to be surely detected even in sleep mode.

The above-described configuration provides the following advantages.

According to a typical case where an image forming apparatus includes two covers and two interlock switches are provided on the respective covers, there is a problem such that when the downstream-side interlock switch in the two interlock switches connected in series to the power line is set off, it is not possible to detect the ON/OFF state of the upstream-side interlock switch, disabling detection of the opening/closure of the covers.

In contrast to the typical case, the first embodiment demonstrates an effect of making it possible to detect the ON/OFF state of each of the first interlock switch and the second interlock switch which are connected in series to the power line, thus enabling detection of the opening/closure of each of the first cover and the second cover.

Specifically, the first embodiment is configured so that the first interlock switch 80 that is set on/off according to the opening/closure of the first cover 40, and the second interlock switch 82 that is set on/off according to the opening/closure of the second cover 41 are connected in series to the power line through which power is supplied to the load 90 from the supply voltage (24 V), the first interlock switch is connected to the supply voltage (24 V) to supply the supply voltage (24 V) to the power line when the first interlock switch 80 is on, and is connected to the detection voltage (3.3 V) which is lower than the supply voltage (24 V) and on which the load 90 does not operate to supply the detection voltage (3.3 V) to the power line when the first interlock switch 80 is off, and the control part 3 detects the opening/closure of each of the first cover 40 and the second cover 41 based on the voltage on the switch-switch power line and the voltage on the switch-load power line. The first embodiment is further configured so that the first comparison part 83 compares the voltage on the switch-switch power line with the first threshold set to a voltage lying between the detection voltage (3.3 V) and the supply voltage (24 V), and compares the voltage on the switch-load power line with the second threshold set to a voltage lying between 0 V and the detection voltage (3.3 V), and the control part 3 detects the opening/closure of the first cover 40 and the second cover 41 based on the comparison results from the first comparison part 83 and the second comparison part 84.

This configuration makes it possible to detect the ON/OFF state of each of the first interlock switch 80 and the second interlock switch 82 which are connected in series to the power line, thus enabling detection of the opening/closure of the first cover 40 and the second cover 41.

Further, the first embodiment is configured so that in sleep mode in which the supply voltage (24 V) is disabled, the control part 3 detects the opening/closure of the first cover 40 based on the result of comparison of the voltage between the first interlock switch 80 and the second interlock switch 82 with the second threshold set to a voltage lying between 0 V and the detection voltage (3.3 V). This makes it possible to surely detect the opening/closure of the first cover 40 even in sleep mode.

Furthermore, the first embodiment is configured in such a way that the current-direction detecting part 86 that detects the current direction on the switch-load power line to detect the supply of electromotive force from the load 90 to the power line is provided so that when the current-direction detecting part 86 detects the supply of the electromotive force from the load 90 to the power line, the control part 3 disables detection of the opening/closure of each of the first cover 40 and the second cover 41. This makes it possible to prevent erroneous detection originated from the electromotive force generated in the load 90.

Second Embodiment

Next, referring to FIGS. 7 to 11, a color printer 1 according to a second embodiment of the present disclosure is described.

In FIGS. 7 to 11, components with the same reference numerals as shown in FIGS. 1 to 6 which are in conjunction with the first embodiment imply that those components have configurations similar to those of the components of the first embodiment.

Figure 7:
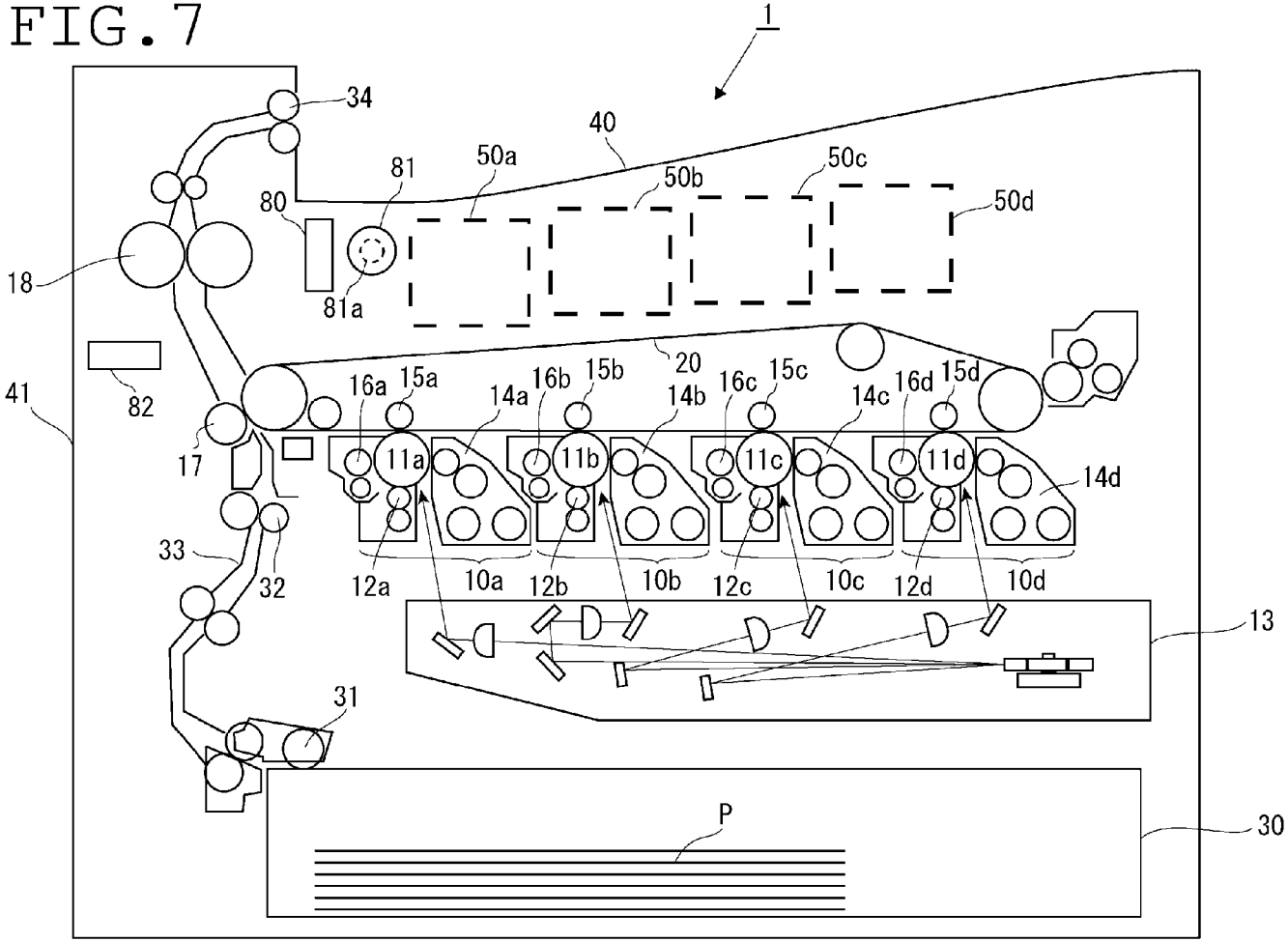
FIG. 7 is a schematic explanatory sectional view illustrating the internal configuration of an image forming apparatus according to a second embodiment of the present disclosure.
Figure 8:
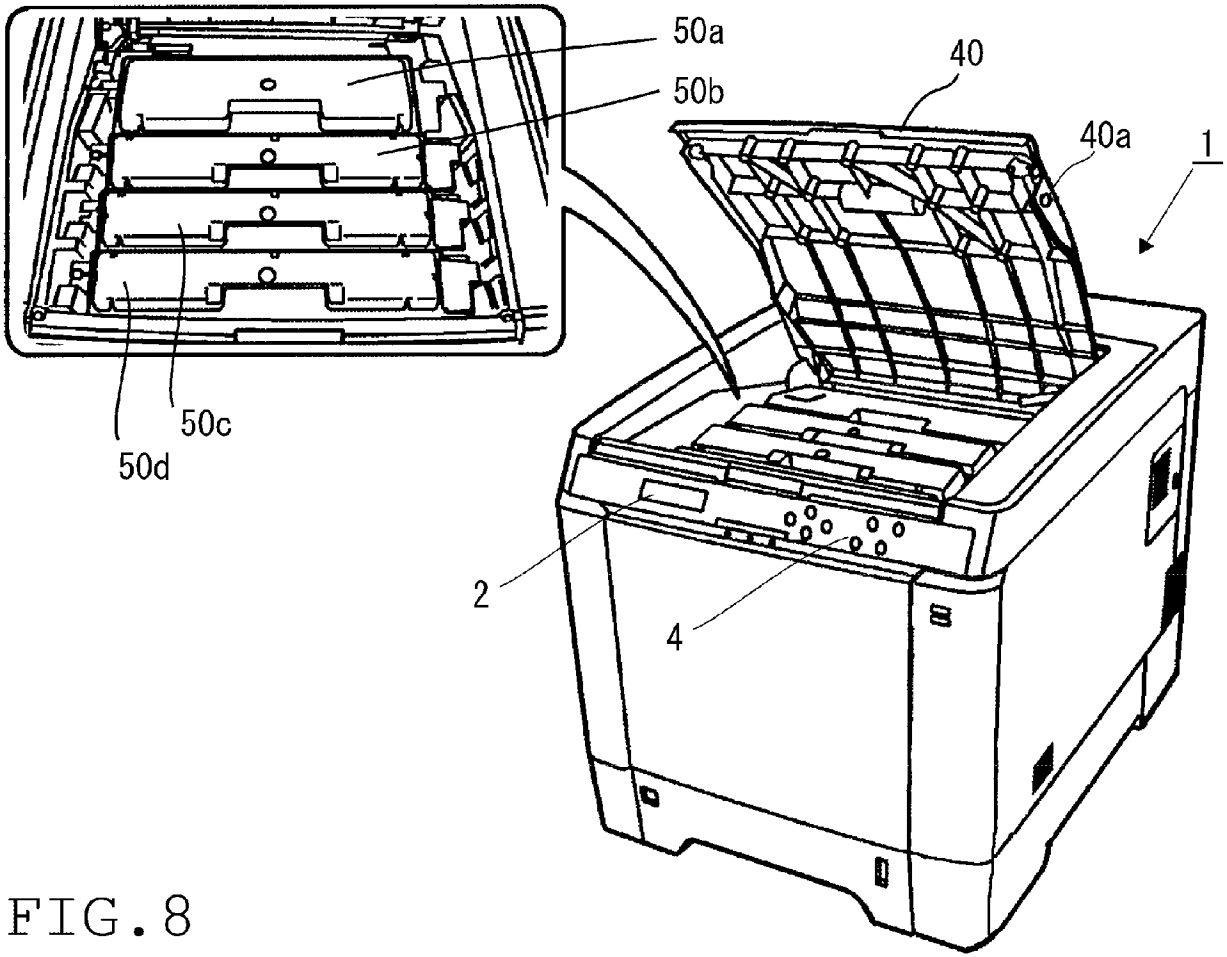
FIG. 8 is an external perspective view illustrating that a first cover of the image forming apparatus illustrated in FIG. 7 is open.

Referring to FIG. 7, a first cover 40 of the color printer 1 is provided with a first interlock switch 80 that is set on/off according to the opening/closure of the first cover 40, and a first cover-lock part 81 that locks the first cover 40 closed. The first interlock switch 80 is configured to be set off with the first cover 40 open to thereby shut off the supply voltage that is supplied to the individual components of the color printer 1. For example, a linear actuator that moves a rod 81*a* forward and backward may be used as the first interlock switch 80. In this case, as the rod 81*a* is moved forward to be inserted into an opening 40*a* (see FIG. 8) provided in the first cover 40, the first cover 40 is locked.

The second cover 41 is provided with a second interlock switch 82 that is set on/off according to the opening/closure of the second cover 41. The second interlock switch 82 is configured to be set off with the second cover 41 open to thereby shut off the supply voltage that is supplied to the individual components of the color printer 1.

Figure 9:
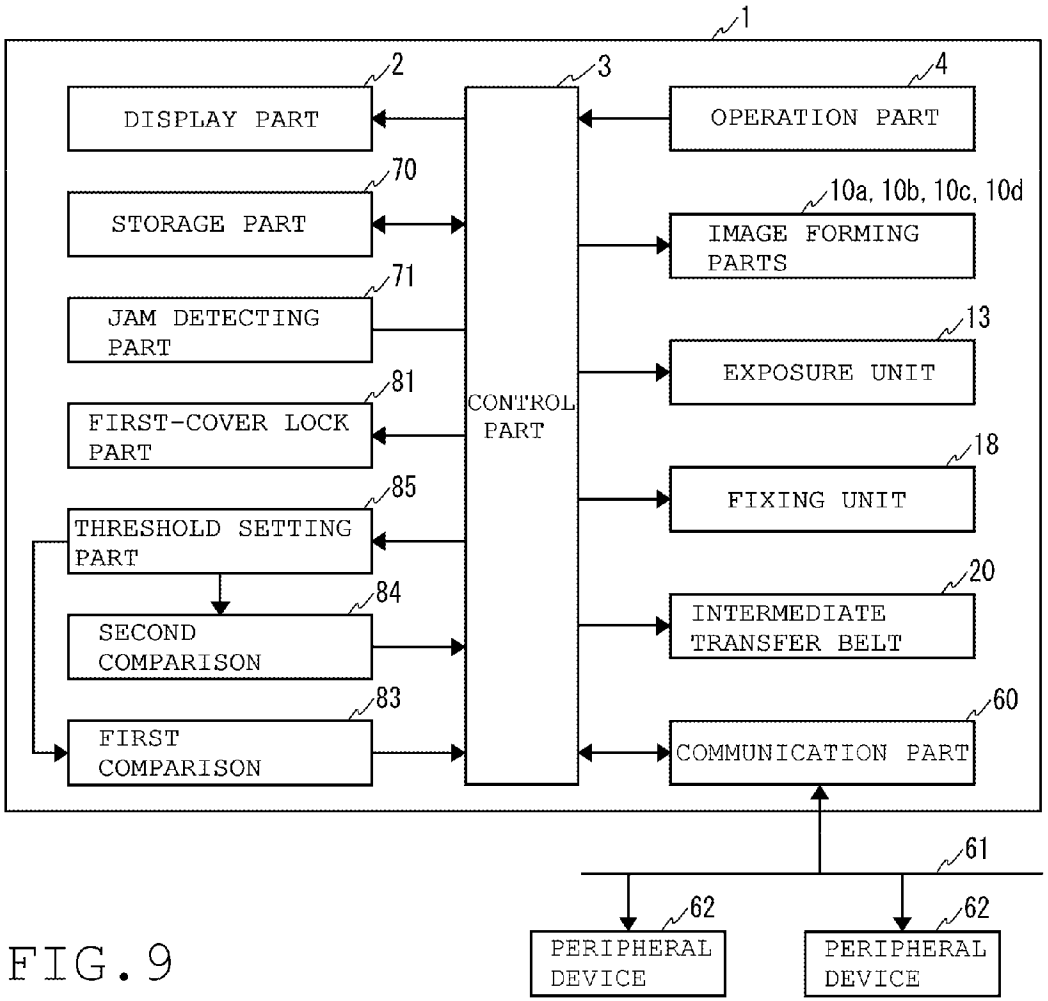
FIG. 9 is a block diagram illustrating the schematic configuration of the image forming apparatus illustrated in FIG. 7.

FIG. 9 is a block diagram illustrating the schematic configuration of the color printer 1. The color printer 1 includes a control part 3 that is connected to a communication part 60, a storage part 70, and a jam detecting part 71. The control part 3 is an information processing part such as a microcomputer including a non-transitory recording medium. A control program for controlling the operation of the image forming apparatus is stored in a ROM. The control part 3 reads out the control program stored in the ROM, and is then loaded into a RAM to control the individual components (such as the image forming parts 10*a*, 10*b*, 10*c*, and 10*d*, exposure unit 13, fixing unit 18 and intermediate transfer belt 20) according to specified instruction information input through the operation part 4 or a print job received over the communication part 60, thereby achieving a sequence of image forming operations. When a specified time elapses without a user's inputting an instruction or instructing to start the image forming operation through the operation part 4, the control part 3 shifts the operation mode from a normal mode to a sleep mode as power control to reduce power consumption. In sleep mode, the control part 3 controls a power supply circuit (not shown) to disable a supply voltage to be supplied to the individual components that achieve the image forming operation, and supplies a voltage sufficiently lower than the supply voltage to some standby components of the control part 3 such as a CPU.

The jam detecting part 71 includes a recording-sheet detecting sensor that detects a recording sheet P which is conveyed on a recording paper conveying path 33. When the jam detecting part 71 detects the recording sheet P for a specified time or longer, or does not detect the recording sheet P at a specified timing, the jam detecting part 71 detects jamming of the recording sheet F (paper jam), and sends a jam detection signal to the control part 3.

The control part 3 is also connected with the first-cover lock part 81. When receiving the jam detection signal from the jam detecting part 71, the control part 3 causes the first-cover lock part 81 to lock the first cover 40 closed. The locking of the first cover 40 by the first-cover lock part 81 may be kept until the jamming of the recording sheet P is cleared, or the first-cover lock part 81 may be configured so that the first cover 40 is unlockable through the operation part 4.

Further, the control part 3 is connected with a first comparison part 83 and a second comparison part 84 that compare voltages on a power line with specified thresholds, and a threshold setting part 85. The control part 3 serves as a cover opening/closure detecting part that detects the opening/closure of the first cover 40 and the second cover 41 according to the outputs of the first comparison part 83 and the second comparison part 84, and displays the results of the detection on the display part 2 as needed to notify a user of the detection results.

The threshold setting part 85 sets thresholds to be compared with voltages on the power line in the first comparison part 83 and the second comparison part 84 in response to an instruction from the control part 3, and changes the threshold in the first comparison part 83 between the normal mode and the sleep mode, and changes the threshold in the second comparison part 84 between a time when jamming is not detected and a time when jamming is detected.

Figure 10:
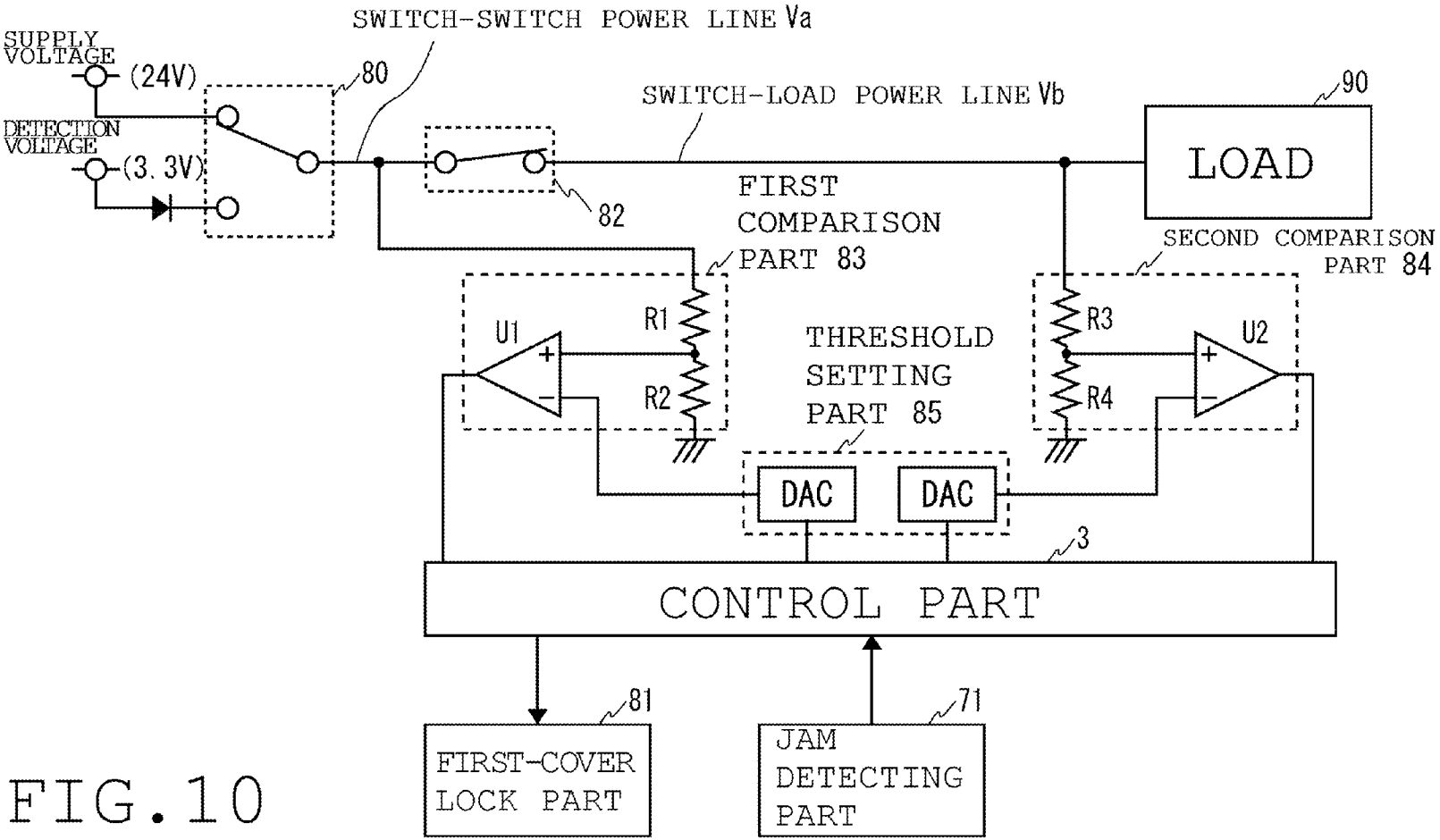
FIG. 10 is a block diagram illustrating the configuration of a cover opening/closure detecting part in the image forming apparatus illustrated in FIG. 7.

Referring to FIG. 10, the first interlock switch 80 and the second interlock switch 82 are connected in series to the power line that supplies power to a load (motor, heater or the like) 90 of each part from the supply voltage. Accordingly, when both of the first cover 40 and the second cover 41 are open or either one of the covers 40, 41 is open, at least one of the first interlock switch 80 and the second interlock switch 82 is set off to shut off the supply of the supply voltage to the load 90 of each part. When both of the first cover 40 and the second cover 41 are closed, both of the first interlock switch 80 and the second interlock switch 82 are set on to supply the supply voltage to the load 90 of each part.

The first interlock switch 80 is a one-circuit-two-contact switch disposed upstream of the second interlock switch 82. The first interlock switch 80 is connected with the supply voltage at a node that is connected when the first cover 40 is ON or closed, and is connected with a detection voltage via a back-flow preventing diode at a node that is connected when the first cover 40 is OFF or open. Accordingly, when the first cover 40 is closed, the supply voltage is supplied to the power line, and when the first cover 40 is open, the detection voltage is supplied to the power line. The detection voltage is the voltage that is sufficient lower than the supply voltage so that the load 90 does not operate on that voltage; for example, a voltage which is supplied to the CPU of the control part 3 in sleep mode is used as the detection voltage. It is assumed according to the second embodiment that the supply voltage supplied is 24 V, and the detection voltage supplied is 3.3 V.

The first comparison part 83 compares a voltage Va on the power line between the first interlock switch 80 and the second interlock switch 82 (hereinafter called "switch-switch power line") with a threshold set by the threshold setting part 85, and outputs the result of the comparison to the control part 3. The second comparison part 84 compares a voltage Vb on the power line between the second interlock switch 82 and the load 90 (hereinafter called "switch-load power line") with a threshold set by the threshold setting part 85, and outputs the result of the comparison to the control part 3.

Referring to FIG. 10, the first comparison part 83 may be configured to include resistors R1 and R2 connected in series between the switch-switch power line and a ground terminal, and a comparator U1 that has a non-inverting input terminal supplied to connected to a node between the resistors R1 and R2 and an output terminal connected to the control part 3. Further, the second comparison part 84 may be configured to include resistors R3 and R4 connected in series between the switch-load power line and the ground terminal, and a comparator U2 that has a non-inverting input terminal supplied to connected to a node between the resistors R3 and R4 and an output terminal connected to the control part 3. In this case, the threshold setting part 85 includes a DAC (D/A converter) that generates a voltage to be input to the non-inverting input terminal of the comparator U1 in the first comparison part 83 and a voltage to be input to the non-inverting input terminal of the comparator U2 in the second comparison part 84.

In normal mode, the threshold setting part 85 sets the threshold to be compared with the voltage Va on the switch-switch power line in the first comparison part 83 to a first threshold that is set to a voltage lying between the detection voltage and the supply voltage. Accordingly, in normal mode, the first comparison part 83 compares the voltage Va on the switch-switch power line with the first threshold. When the voltage Va is higher than the first threshold, the first comparison part 83 outputs a high-level signal to the control part 3. When the voltage Va is lower than the first threshold, the first comparison part 83 outputs a low-level signal to the control part 3. Referring to FIG. 11, in normal mode, the voltage Va on the switch-switch power line becomes 24 V which is the supply voltage when the first cover 40 is closed, and becomes 3.3 V which is the detection voltage when the first cover 40 is open. In normal mode, therefore, the control part 3 detects that the first cover 40 is closed when a high-level signal is input from the first comparison part 83, and detects that the first cover 40 is open when a low-level signal is input from the first comparison part 83.

In sleep mode, the threshold setting part 85 sets the threshold to be compared with the voltage Va on the switch-switch power line in the first comparison part 83 to a second threshold that is set to a voltage lying between 0 v and the detection voltage. Accordingly, in sleep mode, the first comparison part 83 compares the voltage Va on the switch-switch power line with the second threshold. When the voltage Va is higher than the second threshold, the first comparison part 83 outputs a high-level signal to the control part 3. When the voltage Va is lower than the second threshold, the first comparison part 83 outputs a low-level signal to the control part 3. Referring to FIG. 11, in sleep mode, the voltage Va on the switch-switch power line becomes 0 V (which is the supply voltage in sleep mode) when the first cover 40 is closed, and becomes 3.3 V which is the detection voltage when the first cover 40 is open. In sleep mode, therefore, the control part 3 detects that the first cover 40 is closed when a low-level signal is input from the first comparison part 83, and detects that the first cover 40 is open when a high-level signal is input from the first comparison part 83.

Upon detection of no jamming where the jam detecting part 71 does not detect jamming of a recording sheet P, the threshold setting part 85 sets the threshold to be compared with the voltage Vb on the switch-load power line in the second comparison part 84 to a second threshold that is set to a voltage lying between 0 v and the detection voltage. Accordingly, when jamming is not detected, the second comparison part 84 compares the voltage Vb on the switch-load power line with the second threshold. When the voltage Vb is higher than the second threshold, the second comparison part 84 outputs a high-level signal to the control part 3. When the voltage Vb is lower than the second threshold, the second comparison part 84 outputs a low-level signal to the control part 3. Referring to FIG. 11, in normal mode, the voltage Vb on the switch-load power line becomes 0 V, regardless of the open/closed state of the first cover 40, when the first cover 40 is open, and becomes 24 V, which is the supply voltage, or 3.3 V, which is the detection voltage, according to the opening/closure of the first cover 40, when the second cover 41 is closed. In normal mode, therefore, the control part 3 detects that the second cover 41 is closed when a high-level signal is input from the second comparison part 84, and detects that the second cover 41 is open when a low-level signal is input from the second comparison part 84.

In sleep mode, as shown in FIG. 11, the voltage Vb on the switch-load power line becomes 0 V, regardless of the opening/closure of the second cover 41, when the first cover 40 is closed, becomes 3.3 V, which is the detection voltage, when the first cover 40 is open and the second cover 41 is closed, and becomes 0 V when the first cover 40 is open and the second cover 41 is open. In sleep mode, therefore, the control part 3 detects that the second cover 41 is closed when a high-level signal is input from the second comparison part 84 only in the case where a high-level signal is input from the first comparison part 83 and the first cover 40 is open, and detects that the second cover 41 is open when a low-level signal is input from the second comparison part 84.

When the load 90 is a motor, upon detection of jamming where the jam detecting part 71 detects jamming of a recording sheet P, the motor rotates through a process of dealing with jamming of the recording sheet P, generating electromotive force in the load 90 so that the voltage Vb on the switch-load power line may exceed the second threshold. In other words, the second threshold is a voltage which lies between 0 V and the detection voltage and on which the load 90 does not operate. If the second comparison part 84 compares the voltage Vb on the switch-load power line with the second threshold, therefore, when the second cover 41 that opens the recording paper conveying path 33 is opened and jamming of the recording sheet P is dealt with, the electromotive force generated in the load 90 may cause the second comparison part 84 to input a high-level signal to the control part 3, which may result in erroneous detection of the closure of the second cover 41.

According to the second embodiment, therefore, upon detection of jamming, the control part 3 causes the first-cover lock part 81 to lock the first cover 40 closed, and the threshold setting part 85 sets the threshold to be compared with the voltage Vb on the switch-load power line in the second comparison part 84 to a third threshold equal to or higher than the voltage of the electromotive force which lies between 0 V and the supply voltage and may be generated in the load 90 at the time of dealing with jamming. Accordingly, upon detection of jamming, the second comparison part 84 compares the voltage Vb on the switch-load power line with the third threshold. When the voltage Vb is higher than the third threshold, the second comparison part 84 outputs a high-level signal to the control part 3. When the voltage Vb is lower than the third threshold, the second comparison part 84 outputs a low-level signal to the control part 3. Referring to FIG. 11, upon detection of jamming, since the first cover 40 is locked closed, the voltage Vb on the switch-load power line becomes 0 V when the second cover 41 is open, and becomes 24 V, which is the supply voltage, when the second cover 41 is closed. In normal mode, therefore, the control part 3 detects that the second cover 41 is closed when a high-level signal is input from the second comparison part 84, and detects that the second cover 41 is open when a low-level signal is input from the second comparison part 84. It is to be noted that since the third threshold is set equal to or higher than the voltage of the electromotive force which may be generated in the load, the electromotive force generated in the load 90 at the time of dealing with jamming does not cause a high-level signal to be input to the control part 3 from the second comparison part 84, thereby preventing erroneous detection of the closure of the second cover 41. Further, the third threshold and the first threshold may be set common to each other.

Although the first cover 40 whose top portion is openable/closable is also provided with the first interlock switch 80 according to the second embodiment, the cover on which the first interlock switch 80 is provided is not limited; the first interlock switch 80 should be provided on the cover whose opening/closure needs to be surely detected even in sleep mode.

The above-described configuration provides the following effects.

According to a typical case where an image forming apparatus includes two covers and two interlock switches connected in series to the power line are provided on the respective covers, there is a problem such that when the downstream-side interlock switch in the two interlock switches is set off, it is not possible to detect the ON/OFF state of the upstream-side interlock switch, disabling detection of the opening/closure of the covers.

In contrast to the typical case, the second embodiment demonstrates an effect of making it possible to detect the ON/OFF state of each of the two interlock switches which are connected in series to the power line, so that the opening/closure of each of the first cover and the second cover can surely be detected without errors.

Specifically, the image forming apparatus according to the second embodiment includes the first interlock switch 80 that is set on/off according to the opening/closure of the first cover 40, connects the switch-switch power line to the supply voltage when the first interlock switch 80 is on, and connects the switch-load power line to the detection voltage which is lower than the supply voltage and on which the load 90 does not operate, the second interlock switch 82 that enables or disables the switch-load power line according to the opening/closure of the second cover 41, the first comparison part 83 that compares the voltage Va on the switch-switch power line with a set threshold, the second comparison part 84 that compares the voltage Vb on the switch-load power line with a set threshold, the threshold setting part 85 that sets the thresholds which are respectively used in the first comparison part 83 and the second comparison part 84, and the control part 3 that detects the opening/closure of each of the first cover 40 and the second cover 41 according to the results of comparison performed in the first comparison part 83 and the second comparison part 84. The threshold setting part 85 is configured to set the threshold to be used in the first comparison part 83 to the first threshold lying between the detection voltage and the supply voltage in normal mode, and the second threshold lying between 0 V and the detection voltage in sleep mode, and set the threshold to be used in the second comparison part 84 to the second threshold when jamming is not detected, and the third threshold lying between 0 V and the supply voltage and higher than the voltage of the electromotive force, which may be generated in the load 90 at the time of dealing with jamming, when jamming is detected. This configuration provides effects such that the ON/OFF state of each of the first interlock switch and the second interlock switch, which are connected in series to the power line, can be surely detected without errors, and the ON/OFF state of each of the first cover 40 and the second cover 41 can be surely detected without errors. Further, since the third threshold is set equal to or higher than the voltage of the electromotive force which may be generated in the load 90, the electromotive force, which is generated in the load 90 at the time of dealing with jamming, does not cause the second comparison part 84 to input a high-level signal to the control part 3, thereby preventing erroneous detection that the second cover 41 is closed.

Furthermore, the image forming apparatus according to the second embodiment includes the first-cover lock part 81 that locks the first cover closed when jamming is detected. This configuration causes the first cover to be surely set closed when jamming is detected, so that even if the threshold to be used in the second comparison part 84 is set to the third threshold, the opening/closure of the second cover 41 can be detected surely.

The present disclosure is not limited to the above-described first embodiment and second embodiment, and those embodiments may of course be modified as needed within the scope and spirit of the present disclosure.

What is claimed is:

1. An image forming apparatus comprising:

a first cover;

a second cover;

a first interlock switch that is set on/off according to opening/closure of the first cover;

a second interlock switch that is set on/off according to opening/closure of the second cover, the first interlock switch and the second interlock switch being connected in series to a power line through which a load is supplied with power from a supply voltage, the first interlock switch being connected to the supply voltage to supply the supply voltage to the power line when the first interlock switch is on, and being connected to a detection voltage which is lower than the supply voltage and on which the load does not operate to supply the detection voltage to the power line when the first interlock switch is off; and a cover opening/closure detecting part that detects opening/closure of each of the first cover and the second cover based on a voltage on the power line between the first interlock switch and the second interlock switch and a voltage on the power line between the second interlock switch and the load.

2. The image forming apparatus according to claim 1, wherein the cover opening/closure detecting part detects opening/closure of the first cover based on a result of comparison of the voltage on the power line between the first interlock switch and the second interlock switch with a first threshold set to a voltage between the detection voltage and the supply voltage, and detects opening/closure of the second cover based on a result of comparison of the voltage on the power line between the second interlock switch and the load with a second threshold set to a voltage between 0 V and the detection voltage.

3. The image forming apparatus according to claim 1, wherein in sleep mode in which the supply voltage is disabled, the cover opening/closure detecting part detects opening/closure of the first cover based on a result of comparison of the voltage between the first interlock switch and the second interlock switch with a second threshold set to a voltage between 0 V and the detection voltage.

4. The image forming apparatus according to claim 1, comprising a current-direction detecting part that detects a direction of a current on the power line between the second interlock switch and the load to thereby detect supply of an electromotive force from the load to the power line, wherein when the current-direction detecting part detects the supply of the electromotive force from the load to the power line, the cover opening/closure detecting part detects opening/closure of each of the first cover and the second cover.

5. The image forming apparatus according to claim 1, comprising a first-cover lock part that locks the first cover in a closed state.

6. An image forming apparatus comprising:

a first cover;

a second cover;

a first interlock switch that is set on/off according to opening/closure of the first cover, connects a power line through which a load is supplied with power to a supply voltage when the first interlock switch is on, and connects the power line to a detection voltage which is lower than the supply voltage and on which the load does not operate;

a second interlock switch that sets the power line between the first interlock switch and the load on/off according to opening/closure of the second cover;

a first comparison part that compares a voltage on the power line between the first interlock switch and the second interlock switch with a set threshold;

a second comparison part that compares a voltage on the power line between the second interlock switch and the load with the set threshold;

a threshold setting part that sets the threshold which is used in each of the first comparison part and the second comparison part; and a cover opening/closure detecting part that detects opening/closure of each of the first cover and the second cover according to results of comparison performed by the first comparison part and the second comparison part, wherein the threshold setting part sets the threshold to be used in the first comparison part to a first threshold between the detection voltage and the supply voltage in normal mode, sets the threshold to be used in the first comparison part to a second threshold between 0 V and the detection voltage in sleep mode, sets the threshold to be used in the second comparison part to the second threshold when jamming is not detected, and sets the threshold to be used in the second comparison part to a third threshold higher than a voltage of an electromotive force when jamming is detected, the voltage of the electromotive force lying between 0 V and the supply voltage and being likely generated on the load at a time of dealing with jamming.

7. An opening/closure detecting method for use in an image forming apparatus in which a first interlock switch that is set on/off according to opening/closure of a first cover, and a second interlock switch that is set on/off according to opening/closure of a second cover are connected in series to a power line through which a load is supplied with power from a supply voltage, the opening/closure detecting method comprising the steps of:

connecting the first interlock switch to the supply voltage to supply the supply voltage to the power line when the first interlock switch is on;

connecting the first interlock switch to a detection voltage which is lower than the supply voltage and on which the load does not operate to supply the detection voltage to the power line when the first interlock switch is off; and detecting opening/closure of each of the first cover and the second cover based on a voltage on the power line between the first interlock switch and the second interlock switch and a voltage on the power line between the second interlock switch and the load.

* * * * *